US006459191B1

(12) United States Patent
Dombrowski et al.

(10) Patent No.: US 6,459,191 B1
(45) Date of Patent: Oct. 1, 2002

(54) DOME SHIELD FOR PROTECTED METAL HALIDE LAMPS

(75) Inventors: Kevin S. Dombrowski, Painted Post; Thomas W. Morris, Bath, both of NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 288 days.

(21) Appl. No.: 09/606,394

(22) Filed: Jun. 29, 2000

(51) Int. Cl.[7] ..... H01J 1/88; H01J 19/00; H01J 19/12

(52) U.S. Cl. ..... 313/25; 313/238; 313/239

(58) Field of Search ..... 313/25, 26, 17, 313/238, 239, 292, 283, 634, 252, 253; 445/26

(56) References Cited

U.S. PATENT DOCUMENTS 4,281,274 A 7/1981 Bechard et al. ..... 315/49
4,499,396 A * 2/1985 Fohl et al. ..... 313/25
4,942,330 A * 7/1990 Karlotski et al. ..... 313/25
5,051,657 A * 9/1991 Bazin et al. ..... 315/49
5,079,480 A 1/1992 Canale et al. ..... 315/47
5,729,078 A 3/1998 Pragt ..... 313/25
6,153,968 A * 11/2000 Dombrowski et al. ..... 313/238
6,291,933 B1 * 9/2001 Dombrowski et al. ..... 313/17

* cited by examiner

*Primary Examiner*—Ashok Patel
*Assistant Examiner*—Karabi Guharay
(74) *Attorney, Agent, or Firm*—Dicran Halajian

(57) ABSTRACT

A metal halide lamp includes an arc tube and a surrounding tubular quartz sleeve between a wire frame. The wire frame is formed from a pair of substantially parallel wire frame members and a top section where the two frame members meet. The two frame members are mounted to a glass stem containing current supply leads. The sleeve is provided with two pairs of diametrically opposed apertures, each pair of apertures receiving an elongate wire U-clip which engages a pinched end of the arc tube inside the sleeve and the frame members outside the sleeve. A disk having a slot is inserted over a top section of the wire frame through the slot.

11 Claims, 3 Drawing Sheets

DOME SHIELD FOR PROTECTED METAL HALIDE LAMPS

BACKGROUND OF THE INVENTION

The invention relates to a lamp, in particular, a metal halide discharge lamp having a protective sleeve surrounding an arc tube, wherein the sleeve and the arc tube are supported by a metal frame mounted to the stem, and a glass envelope fixed to the stem surrounds the sleeve.

Metal halide lamps typically incorporate a tubular shield surrounding the pressurized arc tube to absorb the impact of dispersing shards in the event the arc tube fractures. Both the shield and the arc tube are supported by a metal frame mounted to the stem, which frame is electrically isolated from the leads for the arc tube. This is especially important for high wattage lamps. Since current carrying members in proximity to the arc tube can cause sodium loss, it is preferable to electrically distance the current carriers from the lateral walls of the arc tube.

U.S. Ser. No. 09/165,681 discloses a metal halide lamp of the type described above, wherein an arc tube and the surrounding shield are supported by a metal frame mounted to the stem. Current is supplied to the arc tube by a braided wire for the lower electrode and a flying lead well spaced from the arc tube for the upper electrode. The construction is especially suitable for a 1000 watt lamp.

Mica shields have been incorporated into metal halide lamps to reduce the amount of reflected heat to the lamp stem or base area, as well as to reduce photo-emissions of the tungsten filament in fail-safe lamps. However, the dome of the outer bulb envelope is left unprotected.

In order to increase safety, it is desirable to protect the dome of the outer bulb envelope if the lamp fails, e.g., during force rupture of the lamp, with minimal increase in manufacturing costs in a lamp having an electrically floating frame.

SUMMARY OF THE INVENTION

According to the invention, a lamp includes a light source having a pair of opposed pinched ends; and a wire frame formed from a pair of substantially parallel wire frame members and a top section where the two frame members meet. A tubular sleeve surrounds the light source between the frame members. The lamp also includes a disk having a slot where the disk is inserted over the top section through the slot. A clip is attached to the tip of the top section and holds the disk in place. The clip has bent sides that form corners which contact the disk. In the event of arc tube failure, the disk protects the dome of the glass outer envelope of the lamp, by assuring that flying fragments will not hit the dome of the outer envelope and cause it to fracture.

These and further advantages will be apparent from the drawing and description which follow.

DETAILED DESCRIPTION OF THE PREFERRED EMBODIMENT

Figure 1A:
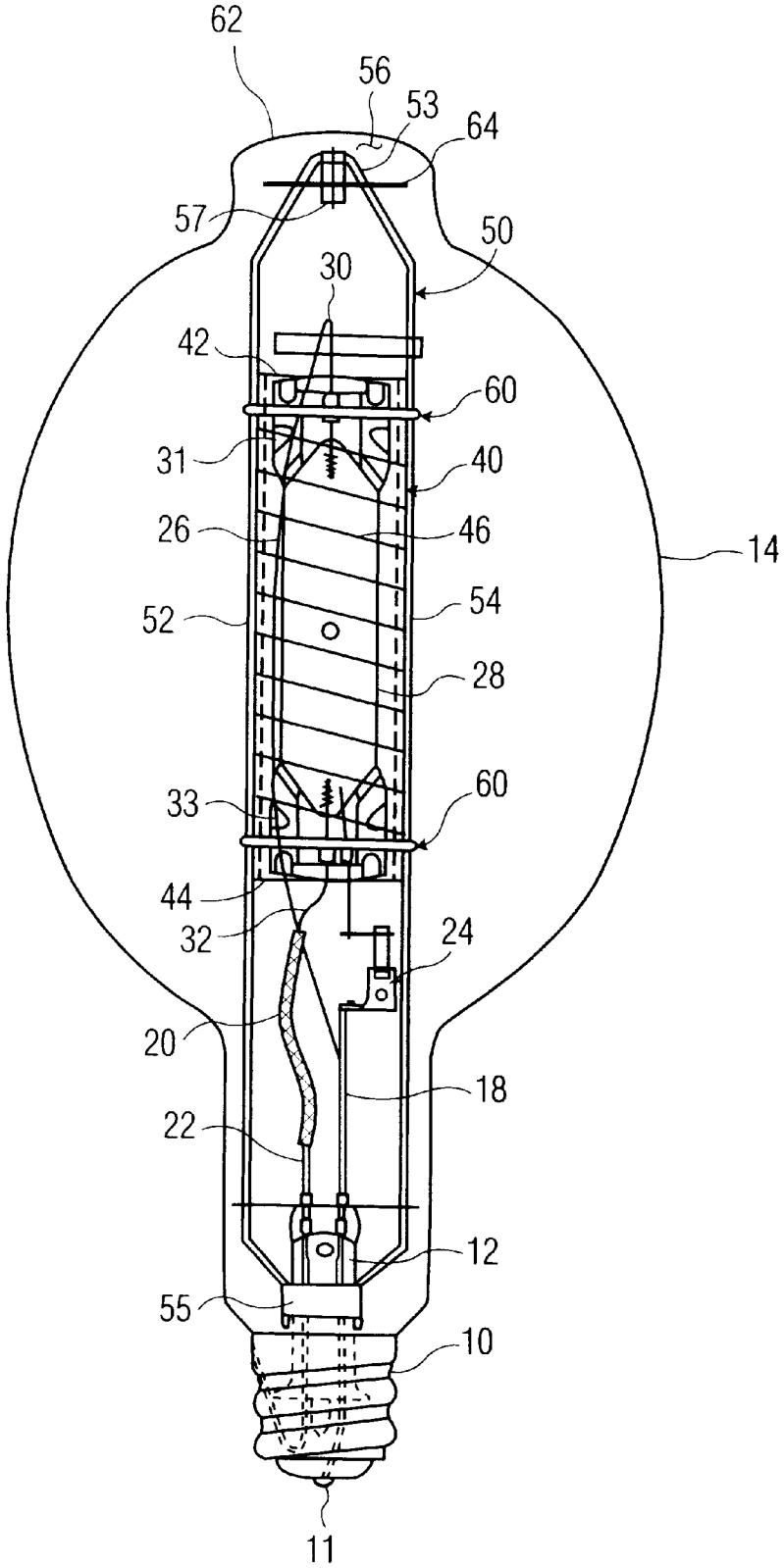
FIG. 1*a* is a side view of the lamp according to the invention.
Figure 1B:
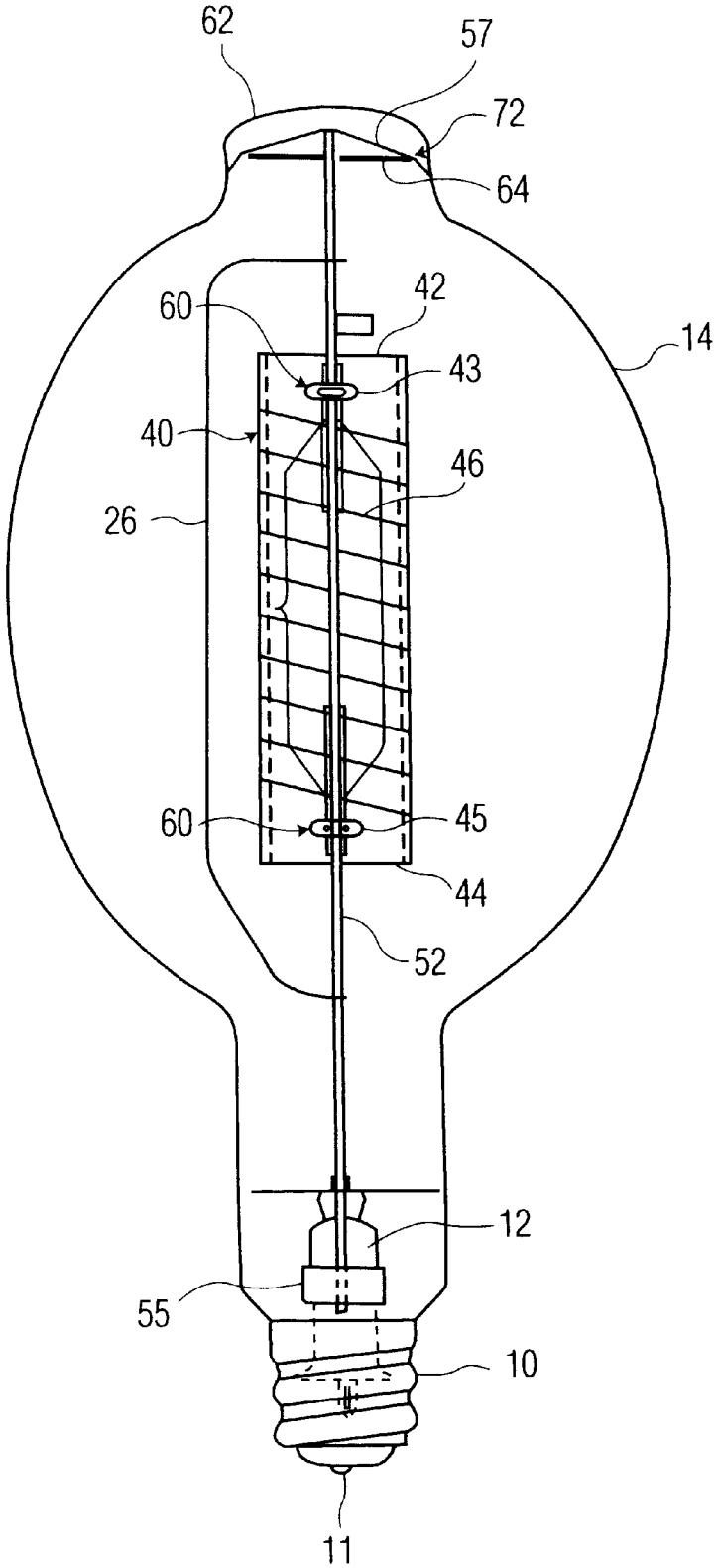
FIG. 1*b* is a side view seen orthogonally to FIG. 1*a* according to the invention.

FIGS. 1*a* and 1*b* show a metal halide discharge lamp including a screw base 10 with an insulated center contact

11, a glass stem 12, and a glass envelope 14 sealed to the stem 12. Inside the lamp is an arc tube 28 with opposed pinched ends 31, 33. A first lead 18 and a second lead 22 are received through the stem 12 and connected to respective lead-throughs 30, 32 in opposed pinched ends 31, 33 of the arc tube 28. These serve as electrodes for maintaining an arc. The first lead 18 is connected to the first lead-through 30 via flying lead 26, while the second lead 22 is connected to the second lead-through 32 via braided connection 20. Before the flying lead 26 carries current, a starter 24 causes a glow discharge at the first end, whereupon a bimetal strip in the starter 24 opens to shunt current through lead flying 26 to the second electrode. Starting circuits are described in some detail in U.S. Pat. No. 5,079,480.

A frame 50 is formed of steel wire and includes a pair of parallel frame members 52, 54 and a top section 53 where the two frame members 52, 54 meet at the top 56 of the frame 50. Each of the members 52, 54 is attached at its lower end to the glass stem 12 via a ring 55, which is slipped over the bottom ends of the members 52, 54. The frame members 52, 54 are electrically isolated from the leads 18, 22. The top 56 of the frame 50 has welded thereto a leaf spring 57 (also referred to as a spring clip), which positions the frame 50 with respect to the envelope 14 and holds a disk 64 as will be described.

A tubular sleeve 40 made of quartz surrounds the arc tube 28 between the upright frame members 52, 54. The quartz sleeve 40 absorbs the impact of flying shards of arc tube in the event of non-passive failure. A wire helix 46 surrounding the sleeve 40 limits radial dispersion of any quartz fragments in the event the sleeve 40 fractures, thus further protecting the glass envelope 14 in the event of arc tube failure. The sleeve 40 has a pair of diametrically opposed apertures 43 adjacent to its upper end 42, and a pair of diametrically opposed apertures 45 adjacent to its lower end 44. Each pair of apertures 43, 45 receives an elongate U-clip 60, having an open end and a closed end. The clips 60 surround the pinched ends 31, 33, respectively, located inside the sleeve 40, as well as the frame members 52, 54 located outside the sleeve 40, as described in U.S. patent application Ser. No. 09/406,288, which is incorporated herein by reference. The apertures 43, 45 are elongate slots which are cut transversely to the axis of the tubular sleeve 40 with a diamond wheel.

The quartz sleeve 40 is present in protected metal halide lamps which may be operated safely in opened fixtures, where there is no front glass. The quartz sleeve 40, which is positioned over the arc tube 28, assists in the containment of the arc tube 28 when the lamp fails, such as during forced (capacitive discharge) rupture testing, for example. However, the top or dome end 62 of the outer bulb jacket or envelope 14 of conventional lamps is prone to damage when the lamp fails, for example, to the extent that penetration of the hot arc tube/shroud components occurs. To eliminate this from occurring, a disk 64 is positioned within the mount structure in such a way as to shield the dome 62 from damage. Illustratively, the disk 64 is a mica disk.

Figure 2:
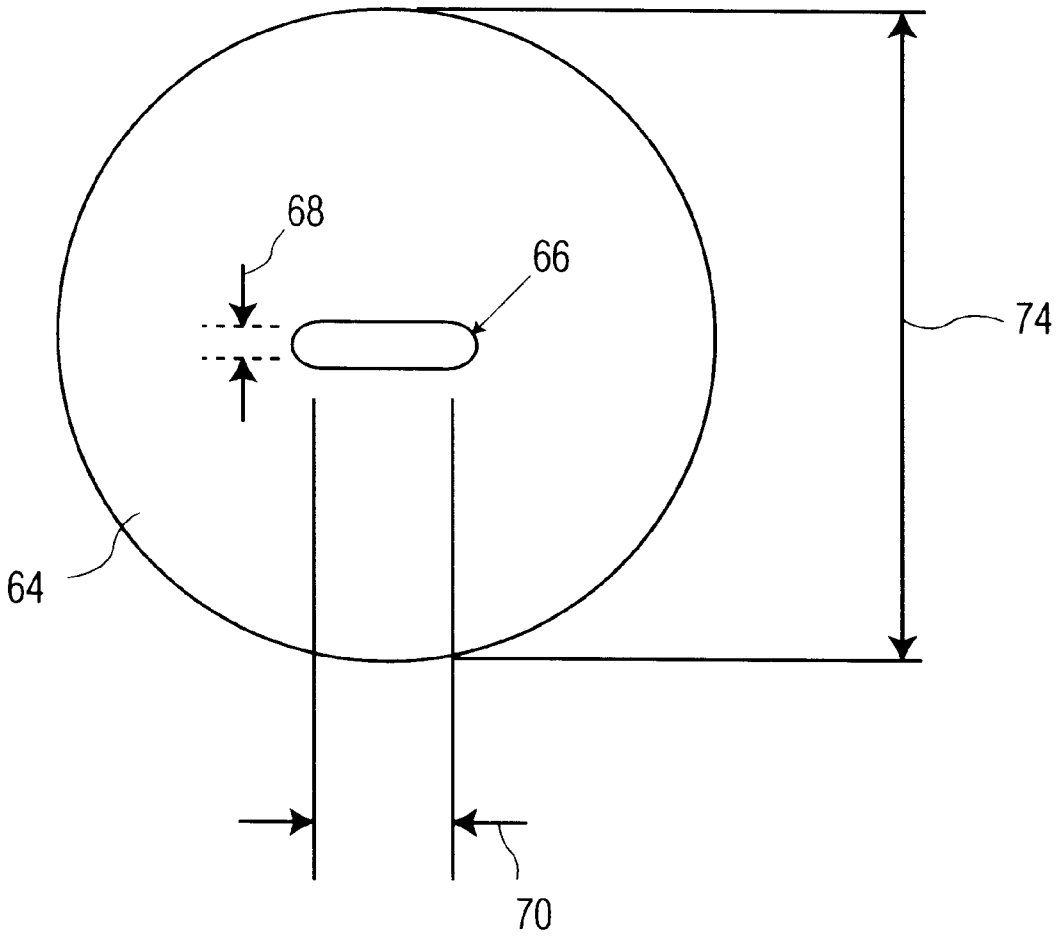
FIG. 2 is a top view of the mica disk according to the invention.

Referring to FIG. 2, the mica disk 64 is shaped to protect the dome 62. Illustratively, the mica disk 64 is circular. The mica disk 64 has a slot 66 in the center, where the width 68 of the slot 66 is equal to the diameter of the wire that forms the frame 50. This allows the mica disk 64 to have a snug fit over the top 56 of the frame 50.

As shown in FIGS. 1*a*, 1*b*, and 2 the length 70 of the slot 66 is sufficiently long so that when the disk 64 is placed over the top end 56 of the main frame 50 to slip over the top frame section 53 through the slot 66, the spring clip 57 can be welded, e.g., resistance welded, in place to the top end 56 of the frame 50, which in turn, the spring clip 57 supports the disk 64 in place.

In particular, as shown in FIG. 1*b*, the edges of the spring clip 57 are bent inward at corners 72 to provide secure support of the disk 64 which contacts the spring clip edges, preferably at or near the corners 72. The overall diameter 74 (FIG. 2) of the disk 64 is such that it covers the major portion of the inside surface of the outer bulb dome 62, thus protecting the dome 62 from contact with the hot ruptured arc tube/shroud fragments when the lamp fails. The diameter 74 of the disk 64 is at least as large as a distance between the parallel wire frame members 52, 54. Illustratively, the length 70 of the slot 66 is approximately 0.320 inches and the diameter 74 of the disk 64 is approximately 1.811 inches.

To assemble the lamp, the frame 50 is mounted by fitting the ring 55 around the stem 14, and bottom ends of the frame members 52, 54, whereupon the arc tube 28 and sleeve 40 are mounted with clips 60. In order to assure that the clips 60 remains firmly engaged to the pinches 31, 32 the clip open ends are welded to frame members 52, 54, respectively. The open ends of the top and bottom clips 60 are in the opposite direction, so that the open ends are welded to opposite frame members 52, 54, respectively. The welding also provides axial stability of the arc tube 28 and sleeve 40 with respect to frame 50. The braided connection 20 and flying lead 26 are then connected between the leads 18, 22 and the arc tube leads 30, 32. Next, the mica disk 14 is placed over the top 56 of the frame 50 through the slot 66, and the leaf spring 57 is placed over the disk 64 and welded to the frame top end 56. Finally, the glass envelope 14 is fitted and sealed to the stem 12 and base 10.

The foregoing is exemplary and not intended to limit the scope of the claims which follow.

What is claimed is:

1. A lamp comprising a light source having a pair of opposed pinched ends;

a wire frame formed from a pair of substantially parallel wire frame members and a top section where the frame members meet;

a tubular sleeve surrounding said light source between said frame members; and a disk having a slot, said disk being inserted over said top section through said slot.

2. The lamp of claim 1, wherein said slot is located in a center of said disk.

3. The lamp of claim 1, wherein said disk has a diameter which is at least as large as a distance between said substantially parallel wire frame members.

4. The lamp of claim 1, further comprising an envelope located around said wire frame, said envelope having a dome located over said disk so that said disk protects said dome when said lamp fails.

5. The lamp of claim 1, further comprises a glass stem and a pair of leads embedded in said glass stem for supplying electrical current to said light source, said frame members being electrically isolated from said leads.

6. The lamp of claim 5, wherein said frame members are formed from a single wire having opposite ends fixed to said glass stem.

7. The lamp of claim 5, further comprising a ring fitted around the glass stem to hold said ends of said frame members around said glass stem.

8. The lamp of claim 1, wherein said disk is formed from mica.

9. The lamp of claim 1, wherein said light source is a metal halide arc tube.

10. The lamp of claim 1, further comprising a clip attached to a tip of said top section, said clip having bent sides that form corners, where said disk contacts said corners.

11. The lamp of claim 10, wherein said clip is located in a plane which is perpendicular to a plane of said pinched ends.

* * * * *